United States Patent [19]

Hirosaki et al.

[11] Patent Number: 4,583,345

[45] Date of Patent: Apr. 22, 1986

[54] AUTOMATIC PACKAGING, MEASURING AND PRICING MACHINE

[75] Inventors: Yukihiro Hirosaki, Shizwoka; Manabu Nishida, Aokihigashi; Kunikazu Sekioka, Shizuoka, Japan

[73] Assignee: Tokyo Electric Co., Ltd., Tokyo, Japan

[21] Appl. No.: 646,063

[22] Filed: Aug. 31, 1984

[30] Foreign Application Priority Data

Aug. 31, 1983 [JP] Japan ..... 58-159745
Aug. 31, 1983 [JP] Japan ..... 58-159746

[51] Int. Cl.[4] ..... B65B 57/02; B65B 61/26

[52] U.S. Cl. ..... 53/77; 53/66; 53/131; 53/137; 53/389

[58] Field of Search ..... 53/66, 64, 77, 137, 53/131, 502, 389; 177/5, 4, 3, 25, 245

[56] References Cited

U.S. PATENT DOCUMENTS

| | | | |
|---|---|---|---|
| 3,093,528 | 6/1963 | Reich | 156/285 |
| 3,194,710 | 7/1965 | Stremke et al. | 156/360 |
| 3,232,804 | 2/1966 | Klopfenstein | 156/60 |
| 3,450,590 | 6/1969 | LaMers | 156/540 |
| 3,712,020 | 1/1973 | Norr et al. | 53/77 X |
| 4,115,981 | 9/1978 | Hell et al. | 53/137 X |
| 4,172,347 | 10/1979 | Nitz | 53/77 X |
| 4,415,048 | 11/1983 | Teraoka et al. | 53/137 X |
| 4,501,106 | 2/1985 | Treiber et al. | 53/66 |

*Primary Examiner*—James F. Coan
*Attorney, Agent, or Firm*—Oblon, Fisher, Spivak, McClelland & Maier

[57] ABSTRACT

The present invention provides an arrangement wherein a cutting length for a film is included in PLU (price look up) data so that, upon PLU operation, a film can be automatically cut into a sheet having a length suitable to envelope therein an article to be packaged.

4 Claims, 14 Drawing Figures

AUTOMATIC PACKAGING, MEASURING AND PRICING MACHINE

FIELD OF THE INVENTION

This invention relates to an automatic packaging, measuring and pricing machine wherein an automatic packaging machine and an automatic measuring and pricing machine are are integrated together, and particularly to an automatic packaging, measuring and pricing machine for automatically cutting a film for packaging.

OBJECT OF THE INVENTION

It is a first object of the present invention to automatically cut a film into a sheet of a required length upon PLU operation of an automatic measuring and pricing machine.

It is a second object of the invention to enable temporary variation of the cutting length of a film without changing the contents of PLU data.

It is a third object of the invention to enable selection whether the cutting length of a film is set by the PLU of an automatic measuring machine or by a packaging machine.

It is a fourth object of the invention to allow selection whether the cutting length of a film is determined in accordance with PLU data or is set by an automatic packaging machine depending upon an operation mode of an automatic measuring and pricing machine.

Other objects of the present invention will be made apparent from the following description.

BRIEF DESCRIPTION OF THE DRAWINS

Figure 9:
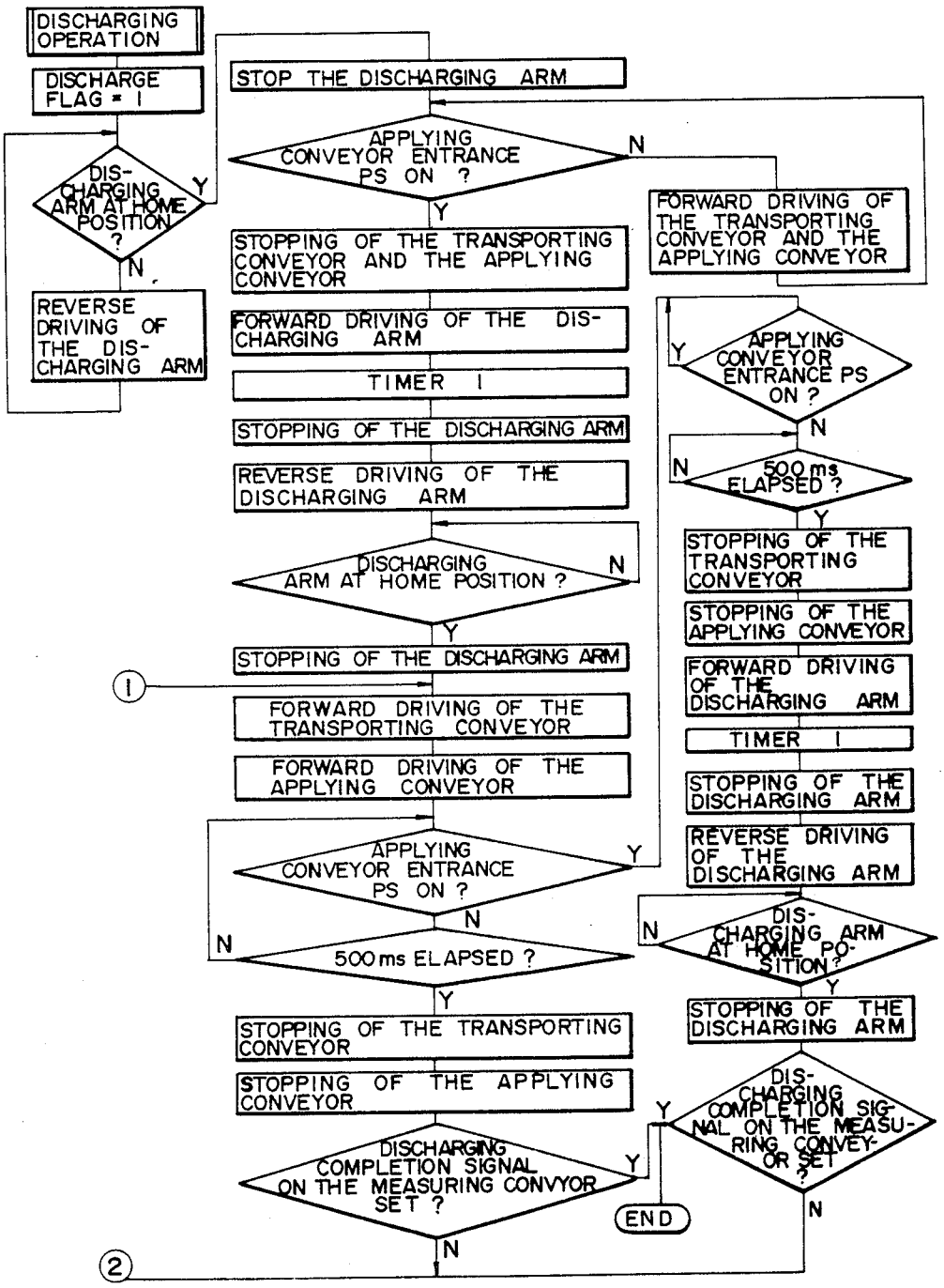
Figure 9:
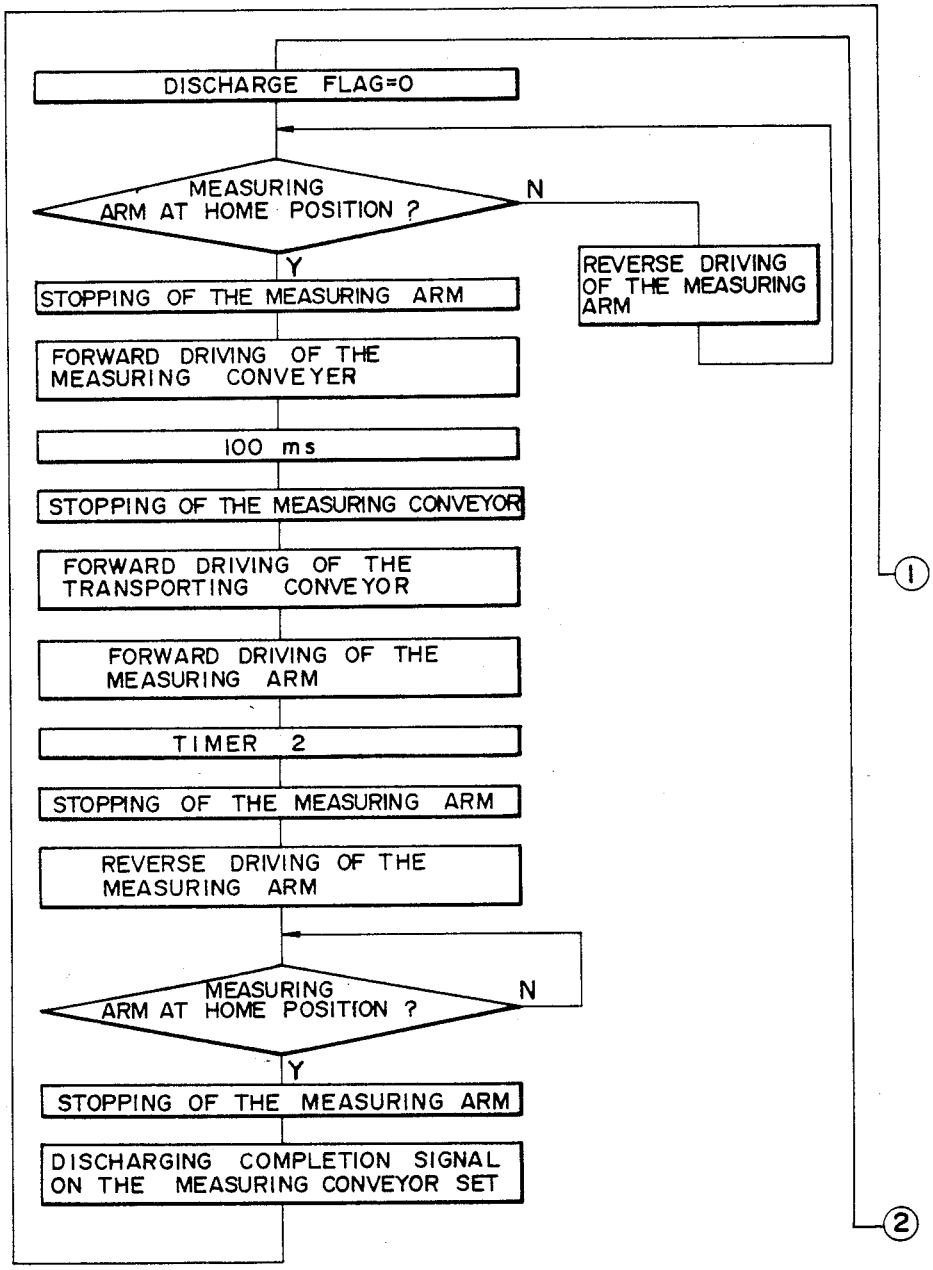
Figure 10:
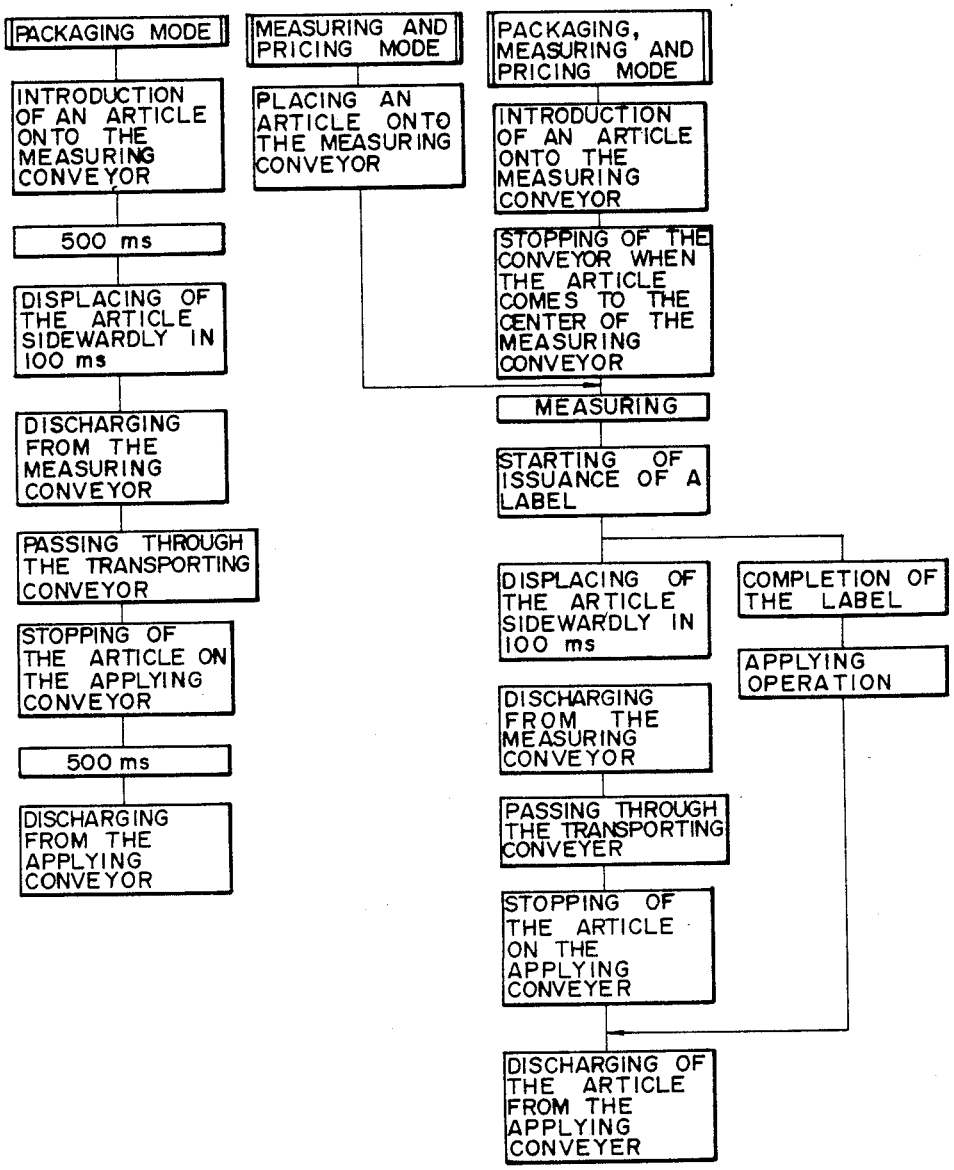
Figure 11:
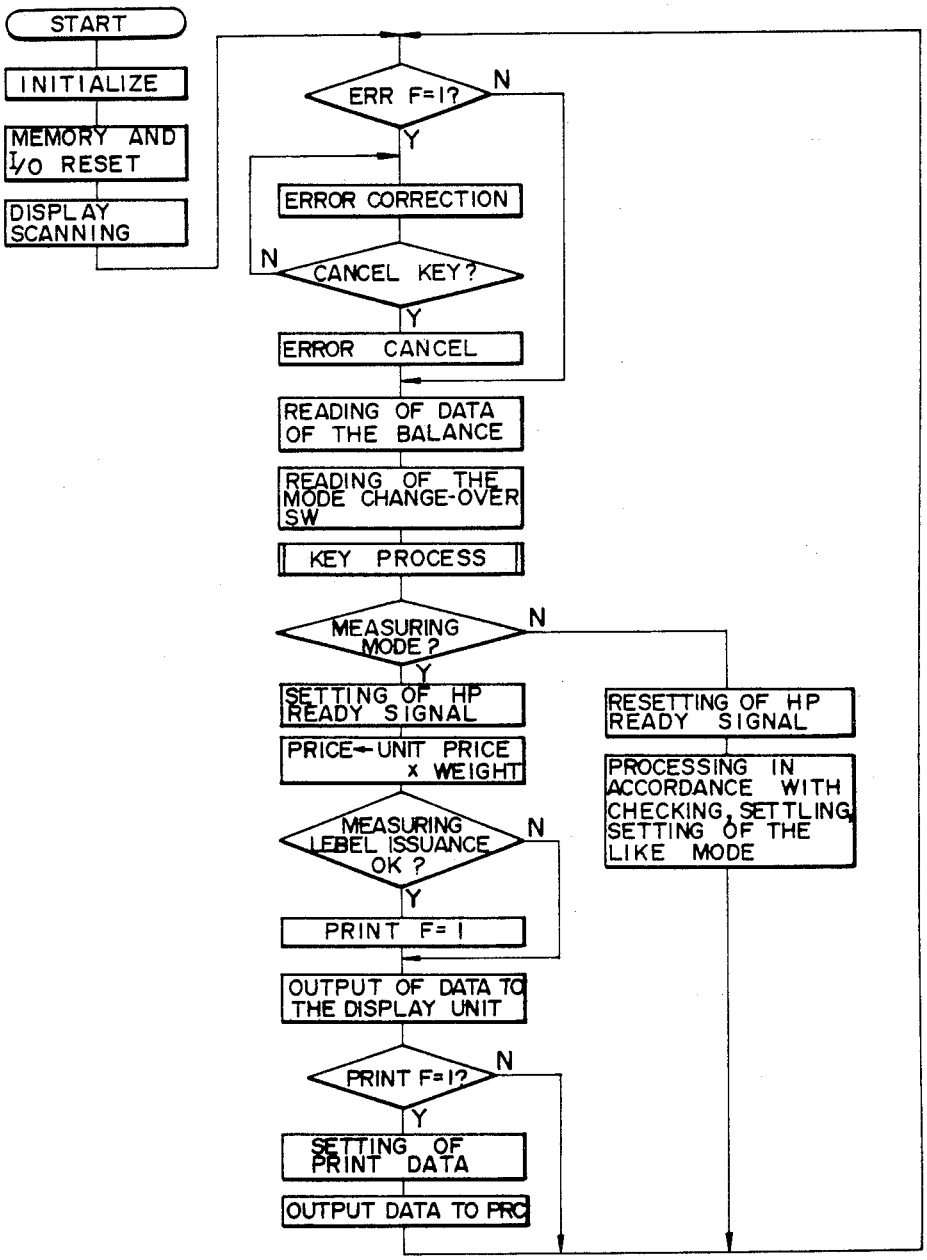
Figure 12:
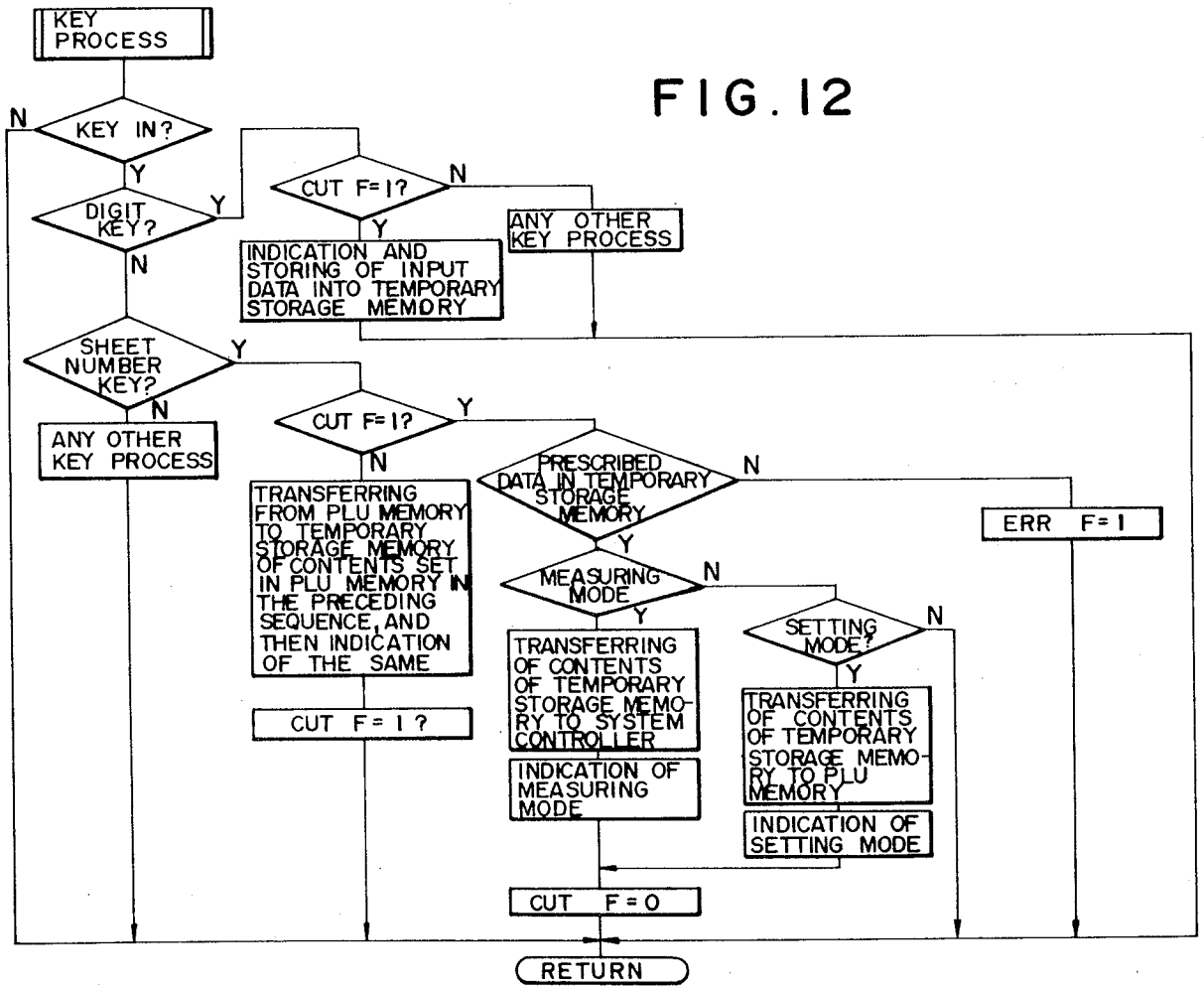

FIGS. 9(A) and 9(B) are a flowchart of a discharging operation;

FIG. 10 is a flowchart of different mode processes;

FIG. 11 is a main flowchart of an automatic measuring and pricing machine;

FIG. 12 is a flowchart of a key process; and

Figure 13:
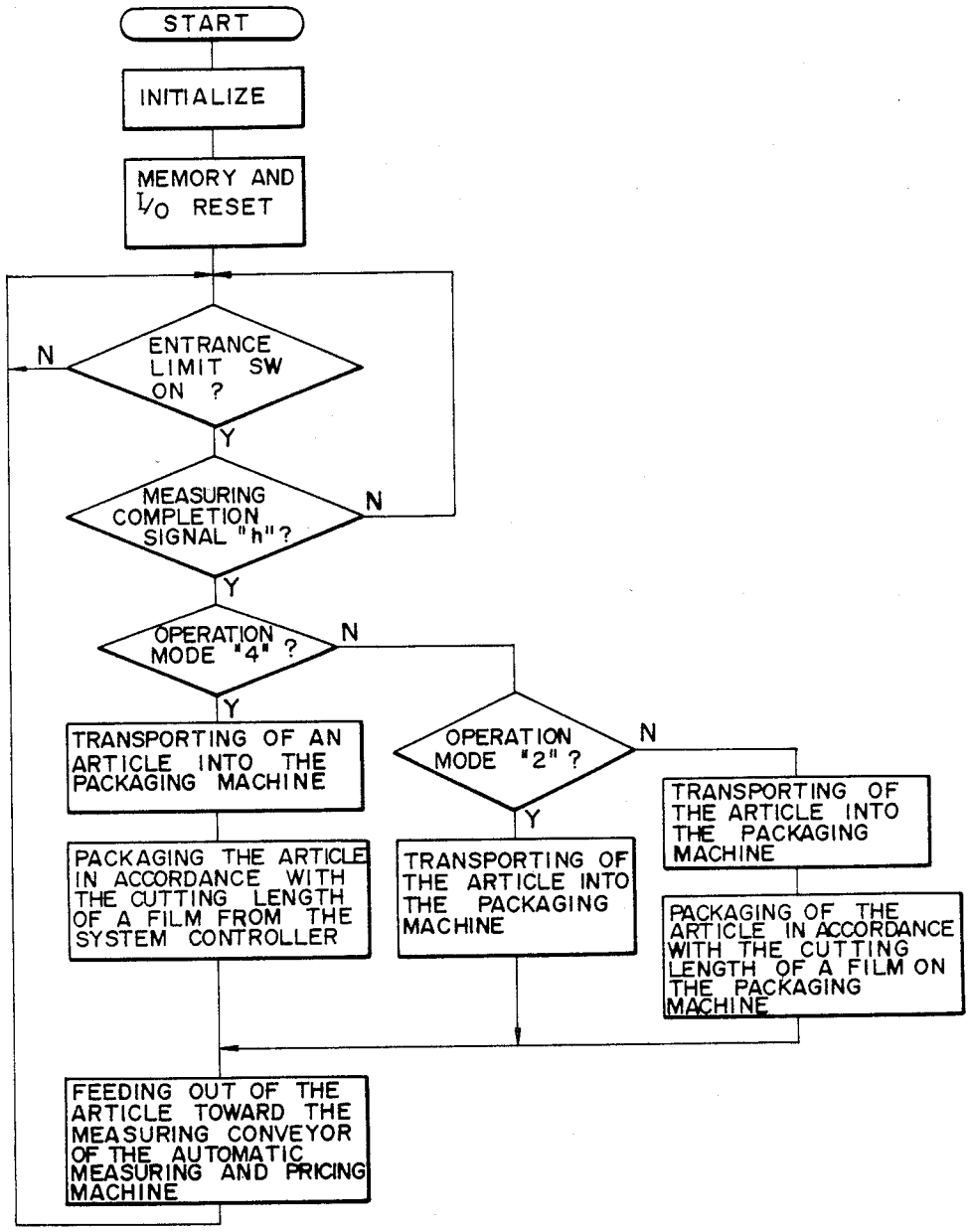

FIG. 13 is a flowchart of an automatic packaging machine.

TECHNICAL BACKGROUND OF THE INVENTION AND PROBLEMS OF THE SAME

In recent years, as the circulation field develops, the demand for a system which packages an article and then measures and prices it has increased, and thus automatic packaging, measuring and pricing machines have been proposed in which an automatic packaging machine and an automatic measuring and pricing machine are integrated together. However, in fact, such two component machines are only structurally combined in an arrangement since it is functionally required to measure and price packaged articles, and it is considered satisfactory if there is no trouble caused against circulation of articles on a conveyor. In other words, the automatic packaging machine and the automatic measuring and pricing machine only operate separately from each other.

Accordingly, settings on the automatic packaging machine such as, for example, a setting of a cutting length of a package film (generally in a packaging machine, a setting of the cutting length of a film is necessary in accordance with an article to be packaged since a package film in the form of a roll is cut into a sheet of a predetermined length which is fed to a position above an article while the article is lifted to the film sheet to cause peripheral edge portions of the film sheet to be bent below the article), a setting of an operation mode of the packaging machine, and so on, are effected by operations of various switches on an operation panel of the automatic packaging machine while, on the other hand, settings on the automatic measuring and pricing machine such as, for example, setting of unit prices, date, an operation mode, and so on, are effected by operations of various switches on an operation panel on the automatic measuring and pricing machine.

Consequently, a setting of the cutting length of a film in conformity with an article inconveniently involves steps then an operator memorizes a value of the length and then an article number is set on the automatic measuring and pricing machine whereafter the film cutting length is set on the automatic packaging machine.

EMBODIMENT OF THE INVENTION

Figure 1:
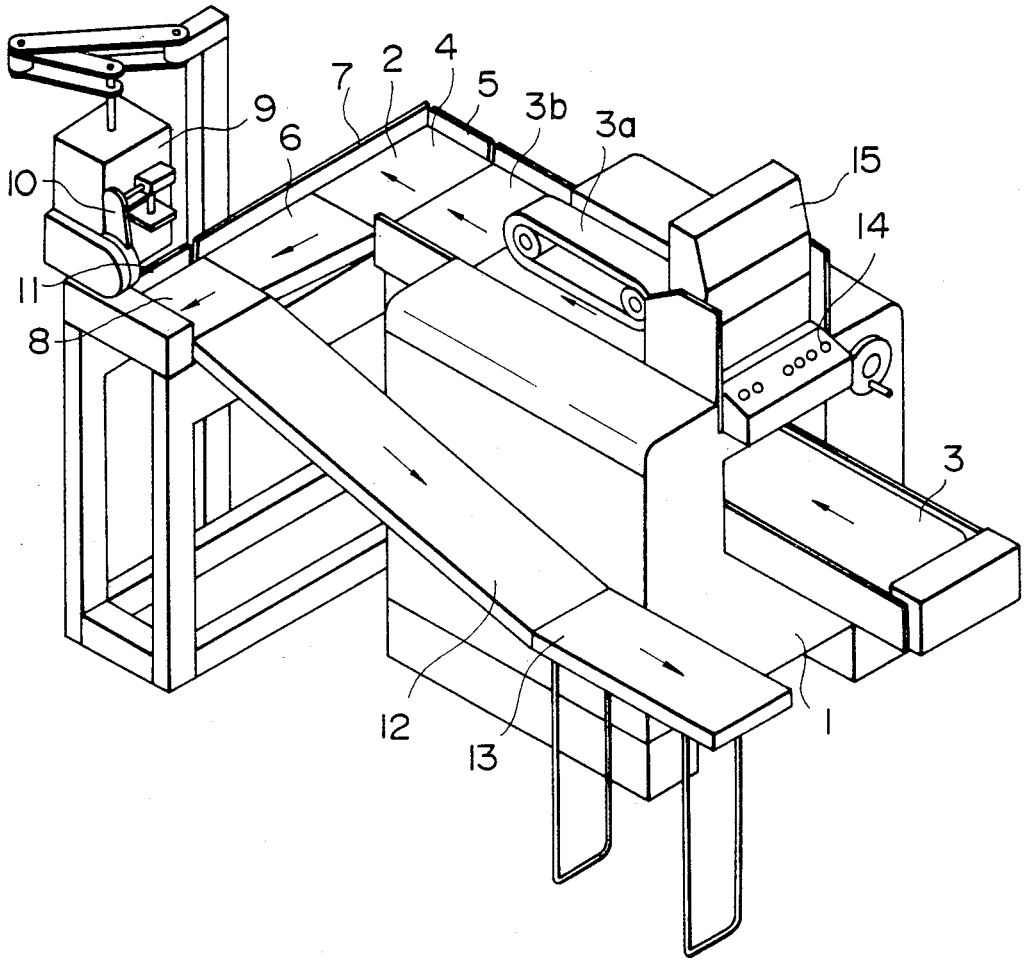
FIG. 1 is a general perspective view of an automatic packaging, measuring and pricing machine.
Figure 2:
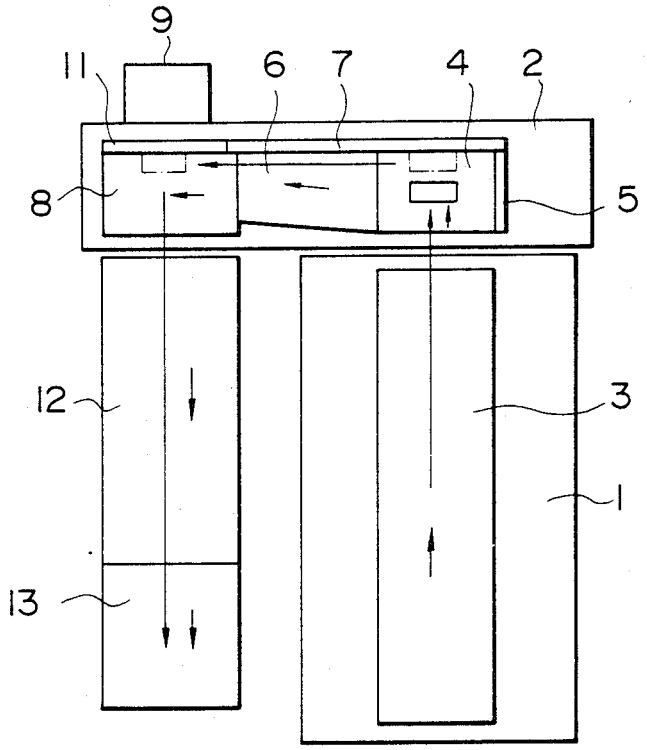
FIG. 2 is a schematic plan view of the machine of FIG. 1.

An embodiment of the present invention will now be described with reference to the accompanying drawings. At first, reference is had to FIG. 1 which schematically shows an outer appearance of an automatic packaging, measuring and pricing machine which basically includes an automatic packaging machine 1 and an automatic measuring and pricing machine 2 integrated together with the automatic packaging machine 1. Thus, at first at the automatic packaging machine 1, an article is placed onto a packaging conveyor 3 thereof and is transported within the packaging machine 1. Midway during such transportation, a package film which has been cut into a sheet of a predetermined length is fed over the article, and then the article is lifted toward the film sheet in order to effect packaging of the article. Then, as the article follows the packaging conveyor 3, it comes to the automatic measuring and pricing machine 2 (more concretely, the article is transported by means of a conveyor 3*a* and a heat conveyor 3*b*). Then, at first, a measuring conveyor 4 is located forwardly of the packaging conveyor 4 onto which the article is transferred. Thus, the measuring conveyor 4 effects measurement of the article. After completion of such measurement, the article is pushed out sidewardly by means of a measuring arm 5 so that it is transferred onto a transporting conveyor 6. The transporting conveyor 6 feeds the article along a transporting guide 7 onto an applying conveyor 8. To the article thus transferred onto the applying conveyor 8, a label issued from a label printer 9 is applied by operation of an applying arm 10. Then, the article is forced out by means of a discharging arm 11 and is discharged toward this side by means of roller conveyors 12 and 13. In FIG. 2, thick arrow marks indicate each a direction in which articles are transported while thin arrow marks indicate each a flow of articles.

Figure 3:
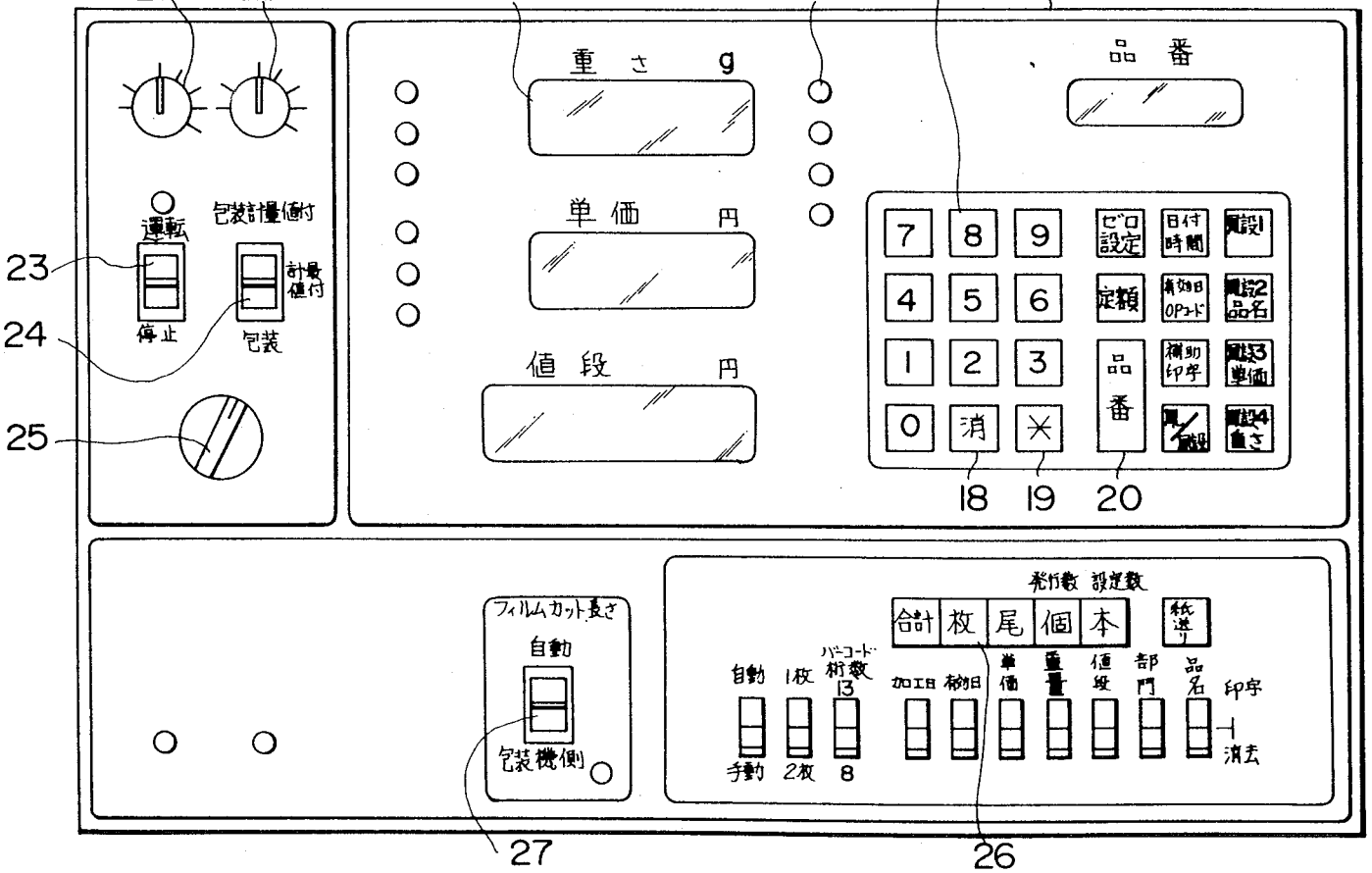
FIG. 3 is a front elevational view of an operating portion of the machine of FIG. 1.

The automatic packaging machine 1 has an operating portion 14 while the automatic measuring and pricing machine 2 has another operating portion 15. The configuration of the operating portion 15 is illustrated in FIG. 3. In particular, the operating portion 15 has an indicator portion 16 for indicating a weight, a unit price, a price and an article number, digit keys 17 for digits of 0 to 9, a cancel key 18, a run key 19, various keys 20 such as an article number key, key switches 21 and 22, an operation switch 23 for operation and stopping, a job change-over switch 24 for changing over among a packaging, measuring and pricing mode, a measuring and pricing mode and a packaging mode, and a power switch 25. The operating portion 15 further includes various keys such as a sheet number key 26, and a change-over switch 27 for selectively determining if a setting of the film cutting length is to be effected together with a PLU setting (automatic) or on the automatic packaging machine 1 side. An LED 28 is used to indicate an error of the like. It is to be noted here that, while not shown in the drawings, a dial for setting a cutting length of a film and so on are provided on the operating portion 14.

Figure 4:
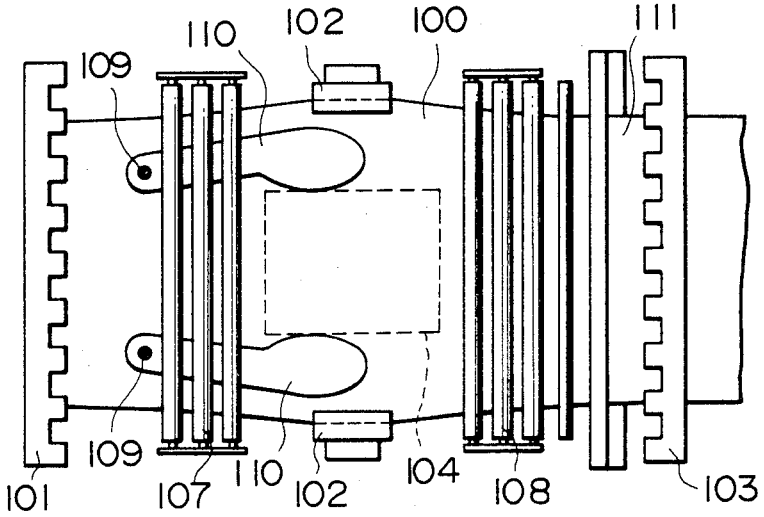
FIG. 4 is a plan view of a packaging mechanism.
Figure 5:
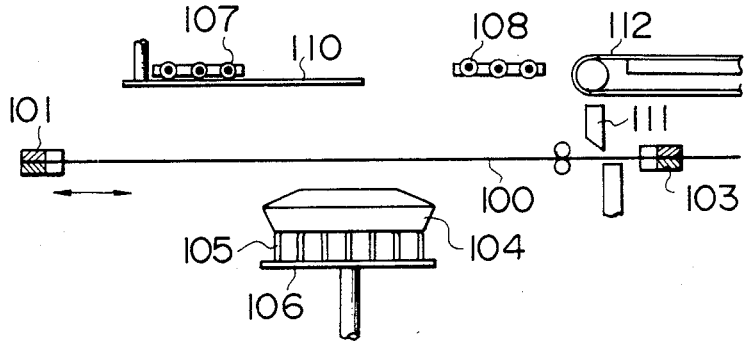
FIG. 5 is a plan view of the packaging mechanism just before its packaging operation.
Figure 6:
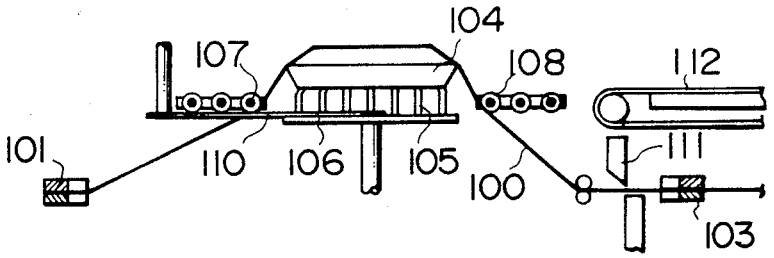
FIG. 6 is a plan view of the packaging mechanism during a packaging operation.

Now, general construction and operations of a packaging mechanism will be described with reference to FIGS. 4 to 6. A film 100 is drawn out from the right to the left hand side, and this is done by means of a film gripping member 101 which grips an end of the film 100 and moves leftwardly. Opposite sides of the film 100 are gripped and pulled in opposite directions by a pair of pulling members 102. A base portion of the thus stretched film 100 is held by another film gripping member 103 after the film 100 has been drawn out. Thus, an article 104 to be packaged is placed on a pushing up member 106 which has claws 105 mounted for rising and lying down movement thereon, and in a position as shown in FIG. 5, the article 104 is pushed up against the film 100 from below and thus pushes up the film 100 to a position as shown in FIG. 6. Then, the film 100 is pressed at two forward and rearward portions thereof by rollers 107 and 108, and a pair of bending plates 110 which are mounted for pivotal motion within a horizontal plane around pivots 109 are pivoted toward the center or toward each other thereby to fold side portions of the film 100 down below the article. At this instant, the film 100 is pulled out of the pulling members 102. Then, the roller 107 is moved rightwardly to fold a left side portion of the film 100 down below the article 104. Then, a cutter 111 is operated to cut the film 100, and the article 104 is fed rightwardly by means of a feed mechanism not shown. At this instant, the roller 108 folds a right side portion of the film 100 down below the article 104. Then, the thus packaged article 104 is placed onto a conveyor 112 and is discharged thereby.

During such a packaging sequence of operations, the film gripping member 101 grips an end portion of the film 100 at a position adjacent the cutter 110 located rightwardly and then in this condition, it moves leftwardly to draw out the film 100. And a position at which the film gripping member 101 stops leftwardly, that is, a travelling amount, determines a film cutting length. Accordingly, the film cutting length is determined by controlling a motor for driving the film gripping member 101.

Figure 7:
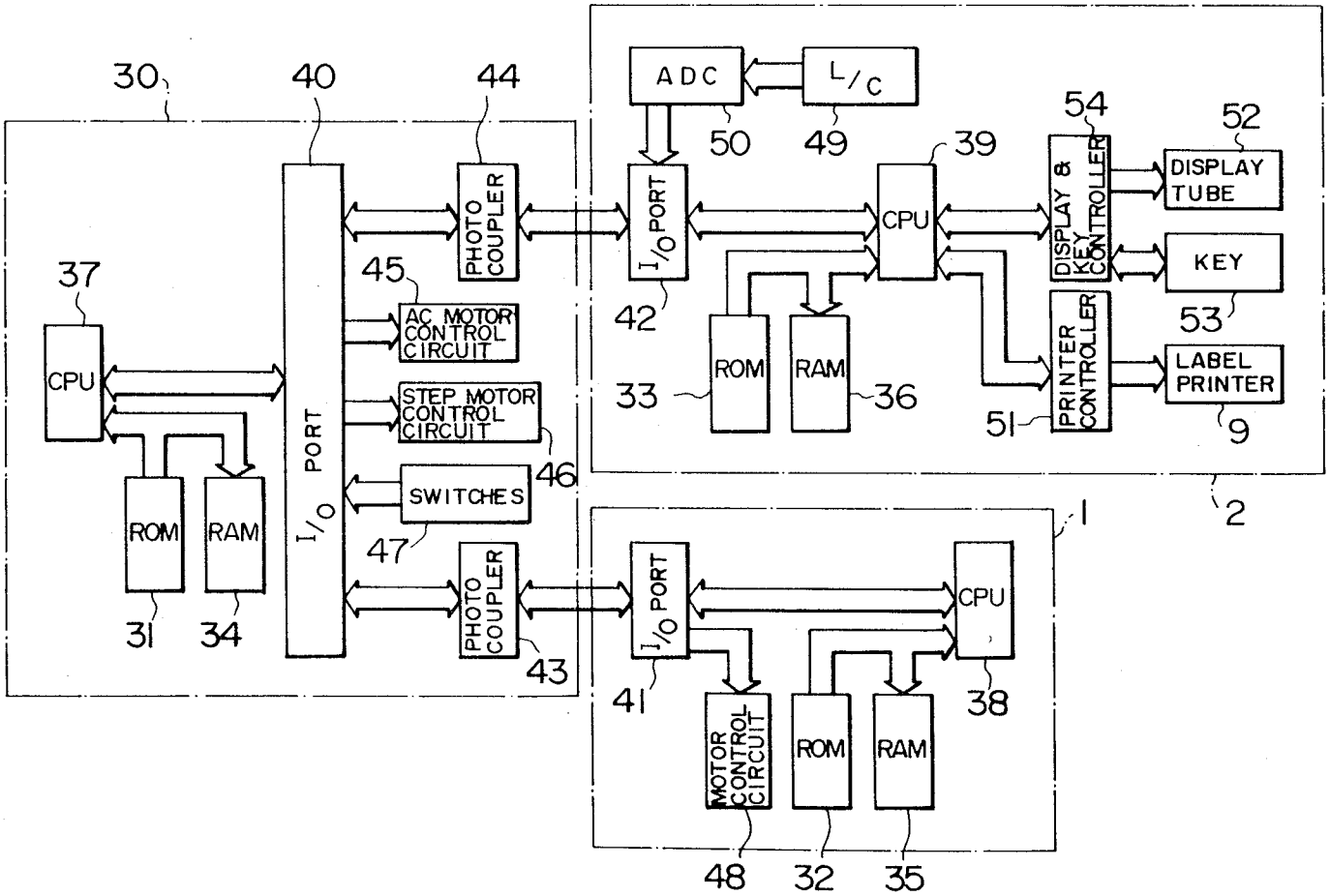
FIG. 7 is a block diagram.

Such a system is controlled by a system controller 30 which is illustrated in FIG. 7. The system controller 30, the automatic packaging machine 1 and the automatic measuring and pricing machine 2 include CPUs 37, 38 and 39 to which ROMs 31, 32 and 33 and RAMs 34, 35 and 36 are connected, respectively, and are interconnected to each other by way of I/O ports 40, 41 and 42 and photo couplers 43 and 44. Connected to the I/O port 40 are an AC motor controlling circuit 45 for controlling AC motors for the measuring conveyor 4, the transporting conveyor 6, the applying conveyor 8, and so on, a stepping motor controlling circuit 46 for controlling a stepping motor for the applying arm 10, and switches 47. Meanwhile, another motor controlling circuit 48 is connected to the I/O port 41. In the meantime, in the automatic measuring and pricing machine 2, an output of measurement from a load cell 49 is coupled to the I?O port 42 by way of an analog to digital converter 50, and to the CPU 39, a printer controller 51 for controlling the label printer 9, a display tube 52 and a display and key controller 54 for the key 53 are connected.

Figure 8:
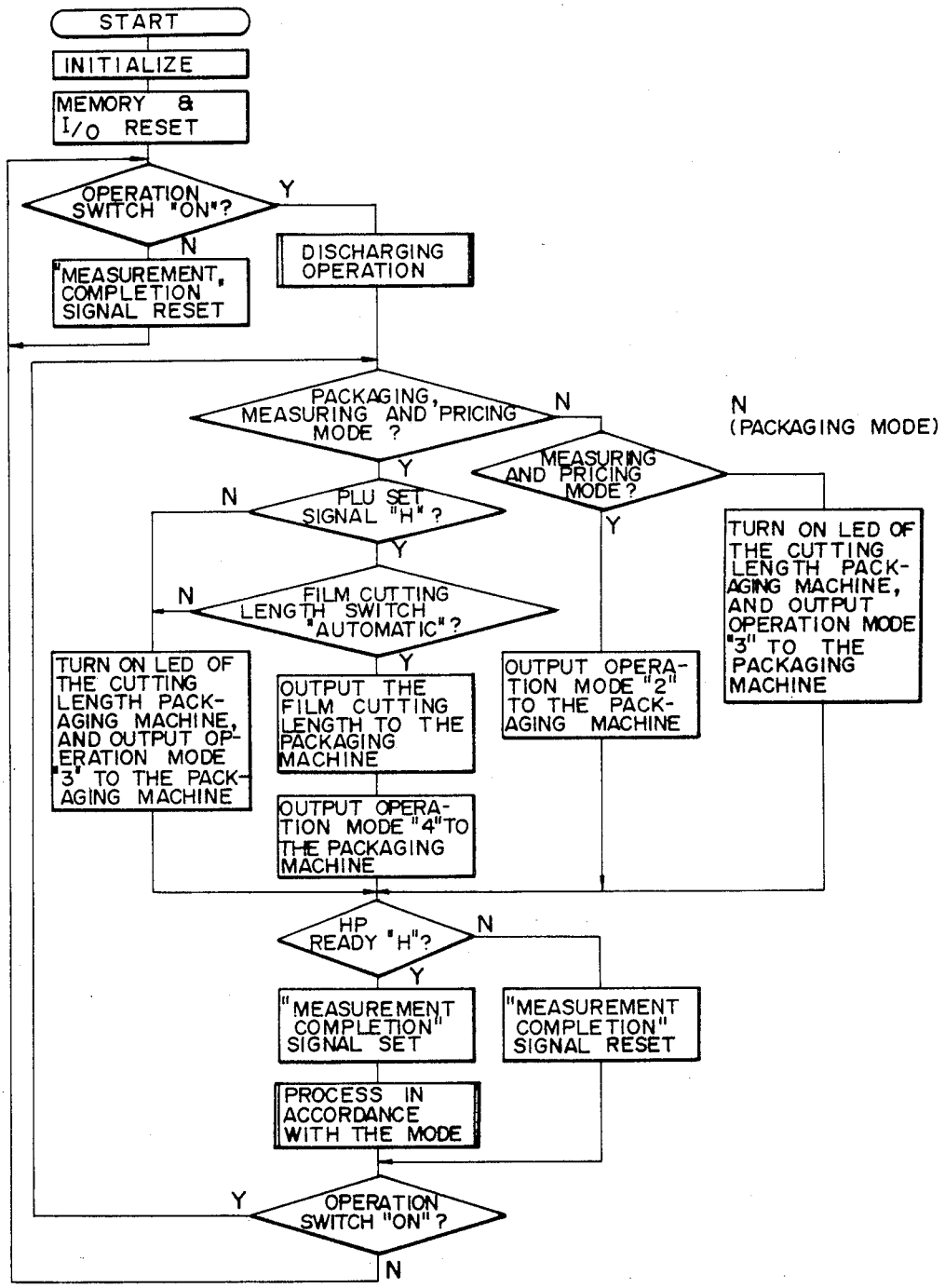
FIG. 8 is a main flowchart of a system controller.

With respect to this construction, a main flow of the system controller 30 is illustrated in FIG. 8. After initialization and subsequent resetting of memory and I/Os, it is judged if the run switch 23 is on or off, and if off is judged, then a "measurement completion" signal is reset, but if on is judged, then a discharging operation is executed. This discharging operation is an initial discharging operation when the power switch is turned on or upon changing over from stopping to running, and is processed following the flowchart of FIG. 9.

At first, under the condition of a discharging flag = 1, if the discharging arm 11 is not in its home position, the discharging arm 11 will be driven reversely and returned to its home position. But if the discharging arm 11 is in its home position, it is held stopped there. Then, if a photo sensor (PS) located at an entrance of the applying conveyor 8 for detecting an article is not on, then the transporting conveyor 6 and the applying conveyor 8 are rotated forwardly to allow transportation of an article onto the applying conveyor 8. Meanwhile, if an article is fed onto the applying conveyor 8 to thus turn the entrance photo sensor on, the transporting conveyor 6 and the applying conveyor 8 are stopped, and a label is applied to the article whereafter the applying conveyor 8 is driven forwardly to effect discharging of the article. Then, a timer 1 process is executed. Here, the timer 1 process means a process for a time required for the discharging arm 11 to move from its home position before it completes discharging of the article. After the timer 1 process, the discharging arm 11 is stopped and is reversely driven to return to its home position at which it is stopped again. Then, the transporting conveyor 6 and the applying conveyor 8 are driven forwardly. Then, if the entrance sensor for the applying conveyor 8 is off, then the forward rotations of the conveyors 6 and 8 are continued until and stopped after lapse of time of 500 ms. On the contrary, if there is an article and thus the entrance photo sensor for the applying conveyor 8 is on, then the conveyors 6 and 8 are continued to be driven forwardly until and are stopped when a time of 500 ms elapses after the article disappeared. At the same time, a discharging operation of the discharging arm 11 is effected. Anyway, at this point of time, if discharging of an article on the measuring conveyor 4 has been completed, then a discharging completion signal is reset and the sequence of operations comes to an end. On the contrary, if discharging of an article on the measuring conveyor 4 is not yet completed, a discharging flag is set to zero. Then, if the measuring arm 5 is not at its home position, then it is driven reversely, but if it is at its home position, then it is stopped there. Here, the measuring conveyor 4 is driven forwardly for a period of time of 100 ms to displace the article sidewardly. Thereafter, the measuring conveyor 4 is stopped and the transporting conveyor 6 is driven forwardly. Subsequently, the measuring arm 5 is driven forwardly to feed and discharge the article from the measuring conveyor 4 to the transporting conveyor 6. Here, the timer 2 means a process for a time required for movement of the measuring arm 5 from its home position until completion of discharging of the article. Then, after lapse of the time, the measuring arm 5 is stopped and then driven reversely until it returns to and is stopped at its home position. Then, discharging of the article on the measuring conveyor 4 is completed and the discharging completion signal is set to drive the transporting conveyor 6 and the applying conveyor 8 forwardly.

Such an initial discharging operation is done by a following reason. In particular, pieces of means and fragments of films or the like are likely left on a conveyor because they are left unpackaged or packaged in error, and if they are left on the measuring conveyor 4, then they will cause a mistake of measurement of an article, and on whichever conveyor they are left, they will prevent smooth transportation of articles. Therefore, in the present embodiment, just after the power switch 25 has been thrown in or when the machine is changed over from a stopped condition to an operating condition as described above, a discharging operation is performed without fail to make the conveyors empty.

After completion of the discharging operation, mode checking is effected. Here, there are up to three modes including a packaging, measuring and pricing mode, a measuring and pricing mode, and a packaging mode, and one of the modes is selected by means of a job change-over switch 24. Now, if in the packaging, measuring and pricing mode, it is detected if a cutting length for a film is set or not. In particular, it is detected if a PLU set signal is at a H level and the change-over switch 27 is at the automatic side position. If the change-over switch 27 is at the automatic side position, then it is considered that a film cutting length has been already set upon setting of a PLU, and hence the film cutting length is delivered to the automatic packaging machine 1. Then, an operation mode "4" is delivered to the automatic packaging machine 1. Here, it is assumed that operation modes which are to be coupled to the automatic packaging machine 1 are determined as indicated in a table below. On the contrary, when a PLU setting signal is in the H level or the change-over switch 27 is not at the "automatic" side, a packaging machine side LED is caused to illuminate at the change-over switch 27 and an operation mode "3" is delivered to the automatic packaging machine

| Operation mode | Contents |
|---|---|
| 0 | Operation of Packaging Machine alone |
| 1 | — |
| 2 | Measuring and Pricing Mode (Packaging Machine Idles and Film does not Come out) |
| 3 | No Connection with Mode (Film Cutting Length is set at Packaging Machine) |
| 4 | Packaging, Measuring and Pricing Mode (Film Cutting Length is set by PLU) |
| 5 | — |
| 6 | — |

-continued

| Operation mode | Contents |
|---|---|
| 7 | — |

1. Meanwhile, if in the measuring and pricing mode, the automatic packaging machine 1 is not involved and hence an operation mode "2" is delivered to the automatic packaging machine 1. Further, if in the packaging mode, then the automatic packaging machine side LED is caused to illuminate at the change-over switch 27.

Then, it is judged if an HP ready signal is at an H level or not. In particular, it is judged if the automatic measuring and pricing machine 2 can operate such as if a load cell balance can accept an article, and if the HP ready is not at the H level, then it is judged that the automatic measuring and pricing machine 2 cannot operate and thus the "measurement completion" signal is reset to disable operation of the automatic packaging machine 1, thus preventing processing of any such mode. On the contrary, if the HP ready is at the H level, then the "measurement completion" signal is set whereafter processing of a pertaining mode is effected. Thus, in other words, it is judged from an HP ready signal if the automatic measuring and pricing machine can operate or not, and the result is delivered to the automatic packaging machine 1. In this way, operation of the automatic packaging machine 1 is controlled from the automatic measuring and pricing machine 2. This is because, if the automatic packaging machine 1 should operate when the automatic measuring and pricing machine is in an inoperable condition, then articles would accumulate on a transporting path, making a cause of a trouble. However, according to the present embodiment, operation of the automatic packaging machine 1 is controlled from the automatic measuring and pricing machine 2 so that the automatic packaging machine 1 may operate only when operation of the automatic measuring and pricing machine 2 is enabled, and hence such a trouble as described above will not be caused.

Here, processes of the individual modes are effected in accordance with the flowchart of FIG. 10. In particular, a cycle of operations will proceed as follows: an article is transported from the automatic packaging machine 1 and is measured (issuance of a label) → the article is fed out onto the transporting conveyor 6 by the measuring arm 6 → the article is transported onto the applying conveyor 8 by the transporting conveyor 6 → a label is applied to the article on the applying conveyor 8 by the applying arm 10 → and the article is discharged by the discharging arm 11. In this cycle, a transporting route is determined by an applying accuracy (position) and so on, and the article is sequentially fed along the guide 7 provided along the route. In the meantime, according to a conventional system, a transporting conveyor is disposed to guide an article from a line parallel to a guide obliquely in a direction toward the guide, but in this arrangement, there is a limit to such an oblique angle when a smooth flow of articles is taken into consideration and thus it is impossible to displace an article to a satisfactory position. Meanwhile, in another method, while a transporting conveyor is disposed to extend in an oblique direction, an article is measured after it has been transported on a measuring conveyor as near to a guide as possible. However, in this method, the article will come to a position significantly displaced from the center position of the measuring conveyor, and hence accurate measurement cannot be expected because of dispersion in accuracy of a balance or because it is difficult to stabilize articles. On the contrary, according to the present embodiment, in any mode of operation, when an article has been transported from the automatic packaging machine 1, the article is stopped at the center position of the measuring conveyor 4 (full line position of FIG. 2) and is measured there whereafter the measuring conveyor 4 is circulated for a period of 100 ms to displace the article laterally toward the guide 7 as shown in phantom in FIG. 2 and then the article is discharged onto the transporting conveyor 6 along the guide 7 by the measuring arm 5. It is to be noted that, in FIG. 10, 500 ms denotes a dummy loop. Further, the processes of the completion of label issuance and the applying operation in the measuring and pricing mode and also in the packaging, measuring and pricing mode are processes which are executed in parallel relationship by an interrupt process.

Meanwhile, a main flow for the automatic measuring and pricing machine 2 is indicated in FIG. 11. After initialization, memory and I/O reset, and display scanning, it is judged if an error flag is 1 or not, and if an error is judged, then an error correction is effected. Then, readings of data of a load cell balance and the mode change-over switch and so on are effected and a key process is then effected. As to the key process, a flowchart principally including setting of a film cutting length is illustrated in FIG. 12. Now, if a digit key 17 is operated, then the input data is displayed since a cut flag becomes 1 and is thus coupled to a temporary memory. Then, a sheet number key 26 is depressed, and if the cut flag is not equal to 1, then the contents which were set in the PLU memory in the preceding cycle is tranferred to the temporary memory and is then displayed whereafter the cut flag is set to 1. On the contrary, if the cut flag is 1, then it is judged if the cutting length in the temporary memory is a prescribed letter or not. Here, a selected one of 25, 30, 35, 40, 45, 50, 55 and 60 cm may be a prescribed data, and hence any other value than the value is an error. As a result, the error flag is set to 1 and an error process as described above is effected. Then, if the value is the prescribed data and it is in the measuring mode, the contents of the temporary memory are transmitted to the system controller 30, and indication of the measuring mode is effected, completing the setting of the cutting length. On the contrary, if in the setting mode, the contents of the temporary memory is coupled to the PLU memory and the indication of the setting mode is effected, thus completing the setting of the film cutting length. After such a key process as described above, controlling of an ordinary balance or a printer is effected in accordance with FIG. 11.

Further, a main flow for the automatic packaging machine 1 is shown in FIG. 13. The automatic packaging machine 1 is held in a stand-by position until a limit switch located at an entrance of the automatic packaging machine 1 for detecting an article is switched on to render the measurement completion signal to an H level whereafter it is controlled in accordance with an operation mode instructed by the system controller 30. Now, if the operation mode is "4", then while an article is transported by the packaging conveyor 3, the article is packaged with a film sheet which has been cut in the film cutting length instructed from the system controller 30 and is then fed to the measuring conveyor 4. Meanwhile, if the operation mode is "2", then an article only passes through the automatic packaging machine 1 and a film sheet is not delivered. Further, in any mode other than the "4" and "2", while an article is transported by the packaging conveyor 3, an article is packaged with a cut film sheet which has been cut into the film cutting length set by the operating portion 14 of the automatic packaging machine 1.

In summary, according to the present embodiment, while specification of PLU data of the automatic measuring and pricing machine 2 is effected by operation of keys on the operating portion 15, a cutting length for a film may be included in the PLU data and can be effected also by operation of keys on the operating portion 15. In a later PLU operation for recalling an article number, the film cutting length corresponding to the article number is recalled from the PLU memory and is set. Thus, operations regarding the film cutting length can be simplified in this manner. Here, although articles of a same article number may have different sizes and hence the film cutting lengths may have to be differentiated thereamong, it can be coped with since the film cutting length can be temporarily varied without changing the contents of the PLU memory as seen from the flowchart shown in FIG. 12. Further, although it is desired, in some manners of use, to set the film cutting length on the automatic packaging machine 1, the present embodiment allows not only the PLU setting but also settings on the automatic packaging machine 1, such selection being provided by means of the change-over switch 27. In addition, by setting of an operation mode on the automatic measuring and pricing machine 2, operations of the automatic packaging machine 1 including at first the setting of the film cutting length can be controlled, resulting in further simplification of operations.

As apparent from the foregoing description, according to the present invention, since, in setting of PLU data on an automatic measuring and pricing machine, a cutting length for a packaging film of an automatic packaging machine 1 is set while included in PLU data so that the film cutting length may be automatically set upon PLU operation, setting operations of a cutting length for a packaging film can be simplified. Besides, since the film cutting length can be temporarily varied without changing the contents of a PLU memory, the machine of the invention can cope with a case in which articles of a same article number may have different sizes thereamong. In addition, since setting of a film cutting length is also possible on the automatic packaging machine, the machine of the invention can cope with various situations accordingly.

What is claimed is:

1. An automatic packaging, measuring and pricing machine which includes an automatic packaging machine and an automatic measuring and pricing machine integrated with said automatic packaging machine, characterized in that, in setting of PLU data of said automatic measuring and pricing machine, a cutting length data for detecting cutting length of a packaging film on said automatic packaging machine is set while included in PLU data so that the film cutting length may be automatically set upon PLU operation.

2. An automatic packaging, measuring and pricing machine which includes an automatic packaging machine and an automatic measuring and pricing machine integrated with said automatic packaging machine, characterized in that, in setting of PLU data of said automatic measuring and pricing machine, a cutting length data for detecting cutting length of a packaging film on said automatic packaging machine is set while included in PLU data so that the film cutting length may be automatically set upon PLU operation and can be temporarily varied without changing the contents of a PLU memory.

3. An automatic packaging, measuring and pricing machine which includes an automatic packaging machine and an automatic measuring and pricing machine integrated with said automatic packaging machine, characterized in that, in setting of PLU data of said automatic measuring and pricing machine, a cutting length data for detecting cutting length of a packaging film on said automatic packaging machine is set while included in PLU data so that the film cutting length may be automatically set upon PLU operation and that it comprises a change-over switch for selectively determining whether the film cutting length is set upon PLU of said automatic measuring and pricing machine or on said automatic packaging machine.

4. An automatic packaging, measuring and pricing machine which includes an automatic packaging machine and an automatic measuring and pricing machine integrated with said automatic packaging machine, characterized in that, setting of PLU data of said automatic measuring and pricing machine, a cutting length data for detecting cutting length of a packaging film on said automatic packaging machine is set while included in PLU data so that the film cutting length may be automatically set upon PLU operation and that it is selectively determined by setting of an operation mode of said automatic measuring and pricing whether the film cutting length is set upon PLU of said automatic measuring and pricing machine or on said automatic packaging machine.

* * * * *